US006572325B2

(12) United States Patent
Kelly

(10) Patent No.: US 6,572,325 B2
(45) Date of Patent: Jun. 3, 2003

(54) FREIGHT CONTAINER AND LIFT CASTING THEREFORE AND METHOD FOR LIFTING AND TRANSPORTING SAME

(75) Inventor: Thomas P. Kelly, Colleyville, TX (US)

(73) Assignee: The Burlington Northern and Santa Fe Railway Co., Fort Worth, TX (US)

( * ) Notice: Subject to any disclaimer, the term of this patent is extended or adjusted under 35 U.S.C. 154(b) by 0 days.

(21) Appl. No.: 09/274,919

(22) Filed: Mar. 23, 1999

(65) Prior Publication Data

US 2002/0064448 A1 May 30, 2002

(51) Int. Cl.[7] ..... G65H 29/00

(52) U.S. Cl. ..... 414/792.7; 414/792.9; 403/410; 220/1.5; 294/68.3

(58) Field of Search ..... 403/410; 220/1.5, 220/4 F; 108/56.1; 214/10.5 R; 414/792.7, 792.9; 294/68.3

(56) References Cited

U.S. PATENT DOCUMENTS 3,973,684 A * 8/1976 Di Martino ..... 214/10.5
4,212,251 A * 7/1980 DiMartino ..... 24/73 R
4,521,941 A * 6/1985 Gerhard ..... 24/287
4,695,184 A * 9/1987 Robinshaw et al. ..... 403/410
4,836,395 A * 6/1989 Goutille ..... 220/1.5
5,332,274 A * 7/1994 Baumann ..... 294/68.3
5,382,066 A 1/1995 Kelly ..... 294/68.3
5,390,827 A * 2/1995 Toth et al. ..... 222/181
5,582,451 A * 12/1996 Baumann ..... 294/68.3
5,678,715 A * 10/1997 Sjostedt et al. ..... 220/1.5
5,782,519 A * 7/1998 Baumann ..... 294/68.3
6,016,634 A * 1/2000 Sayer ..... 52/648.1

* cited by examiner

*Primary Examiner*—Joseph A. Fischetti
(74) *Attorney, Agent, or Firm*—James E. Walton; Hill & Hunn LLP

(57) ABSTRACT

A freight container for use in intermodal freight transportation systems that includes lift castings having a top lift aperture located on the lift casting at an outboard position, such that when other containers are stacked on top of the container, loads are properly distributed through reinforcement beams of the container, thereby substantially reducing bending stresses in the container, substantially reducing the possibility fatigue failure of the container, and reducing the costs of maintenance and inspection of the container.

18 Claims, 17 Drawing Sheets

FREIGHT CONTAINER AND LIFT CASTING THEREFORE AND METHOD FOR LIFTING AND TRANSPORTING SAME

BACKGROUND ART

1. Field of the Invention

The present invention relates generally large freight containers used in intermodal freight transportation systems, in which the freight containers are stacked upon each other and transported by truck, rail, ship, and combinations thereof. In particular, the present invention relates to a freight container having an improved lift casting that are compatible with existing lift mechanisms and existing freight containers.

2. Description of Related Art

Large freight containers used in intermodal freight transportation systems are well known in the art. The intermodal freight transportation industry has always been very competitive. As with most competitive industries, any technological innovation that provides a competitive advantage is highly sought after. Thus, there is an ever-present need for faster, better, safer, and cheaper methods of transporting goods, both domestically and internationally.

In an effort to achieve maximum strength at minimum weight, these large freight containers are typically made of steel frames and aluminum skins. Load-bearing steel reinforcement beams are integrated into the exterior of the container in the walls, ceiling, and floor at certain industry-recognized locations along the lengths of the containers. These reinforcement beams provide the necessary strength to allow the freight containers to be lifted and stacked on top of each other. The reinforcement beams are comprised of side posts integrated into the container walls, headers integrated into the container ceilings, and footers integrated into the container floors. The headers are connected to the side posts at "lift" castings. The footers are connected to the side posts at "stack" castings. Unfortunately, due to height restrictions and strength requirements, lift castings and stack castings must protrude into the interior of the container. This intrusion not only reduces the available storage volume of the container, but makes it difficult to load the container, as well. Operators must maneuver cargo around these intrusions to prevent damaging the cargo or the castings. This is costly both in the amount of cargo that can be shipped, and in the additional time required to load a container.

Individual lift castings and stack castings usually have apertures on both their tops and their sides that allow the container to be lifted by conventional lift mechanisms, or cranes. The lift mechanisms lift, move, and stack the containers on top of each other between the different modes of transportation. These lift mechanisms have hydraulically actuated arms and lift attachments that are adapted to spread to the appropriate width and attach to the container through either the side apertures or the top apertures in the lift castings. The apertures in the stack castings are aligned with the apertures in the lift castings so that the containers can be coupled together by standard inter-box connectors ("IBC's").

Over the years, the desire to pack increased volumes of freight into a container has led to an evolutionary increase in the length and width of freight containers. Due to certain height restrictions in the transportation of containers over land and rail, such as the clearance height of bridges and tunnels, the overall height of the containers has generally remained unchanged. However, containers have increased from a length of 40' and width of 96" to lengths as long as 53' and widths as wide as 102". Although larger containers are able to hold a greater volume of freight, significant structural problems arise when larger containers are used in conjunction with smaller containers in the overall intermodal transportation system.

For example, when all of the containers in an intermodal transportation system are of the same size, one container can be stacked on top of other containers, and the reinforcement beams of the containers remain aligned. Thus, the load of the upper container is transmitted through the stack casting of the upper container, through the inter-box connector, through the lift casting of the lower container and down to the stack casting of the lower container to the stacking surface. On the other hand, when larger containers are used with smaller containers, the reinforcement beams and castings of the larger container do not align with the reinforcement beams and castings of the smaller container. This offset creates undesirable bending moments and bending stresses in the reinforcement beams and castings of both containers, thereby causing the reinforcement beams and castings on the containers to buckle and fail under the bending loads. In addition, because prolonged vibration of stacked containers in intermodal transportation often leads to fatigue failure of the reinforcement beams, constant and expensive container maintenance and inspection programs are required.

A number of efforts have been made to alleviate this problem. For example, intrusive support braces have been added to the lift castings, additional reinforcement plates have been added to the exterior of the containers adjacent to the lift castings, and additional mounting apertures have been added to the stack castings. Some containers have lift castings that do not allow other containers to be stacked on top of the container at all.

With these increases in container size, it has been necessary to modify the design of lift castings and stack castings, as well. However, due to the long life of these freight containers, and the large number of older containers currently in service, it is inevitable that new containers will be used in intermodal transportation systems with existing containers. Thus, it is desirable that newly designed containers include lift castings and stack castings that align with the lift castings and stack castings of older containers, thereby making new containers backward compatible with older containers.

Despite the above-mentioned advances in the art, there is a need for an improved freight container for use in intermodal freight transportation systems that has lift castings in which a top lift aperture is located at an outboard position, so that when other containers are stacked on top of the improved container, the load is properly distributed through reinforcement beams of the improved container.

There is also a need for an improved lift casting for use on freight containers, the improved lift casting having a top lift aperture that is located at an outboard position.

In addition, there is a need for an improved bayonet-type twist lock mechanism for use on freight container lift mechanisms, the bayonet-type twist lock having a shorter tapered point that extends into the lift casting a shorter distance than existing bayonet-type twist locks.

Also, there is a need for an improved method of lifting and transporting freight containers.

BRIEF SUMMARY OF THE INVENTION

Because the prior art does not meet the needs of the intermodal freight transportation industry, it is an objective of the present invention to provide an improved freight container for use in intermodal freight transportation systems that includes lift castings having a top lift aperture located on the lift casting at an outboard position, such that when other containers are stacked on top of the improved container, loads are properly distributed through reinforcement beams of the improved container.

It is another objective of the present invention to provide an improved lift casting for use on freight containers, the improved lift casting having a top lift aperture that is located at an outboard position of the lift casting.

It is another objective of the present invention to provide an improved lift casting for use on freight containers, the improved lift casting being of shorter height, thereby creating less intrusion into the interior of the container.

It is another objective of the present invention to provide an improved freight container having lift castings that substantially reduce bending stresses in reinforcement beams of the improved container, thereby preventing failure of the improved container due to the bending stresses.

It is another objective of the present invention to provide an improved freight container having lift castings that substantially reduce fatigue stresses in reinforcement beams of the improved container, thereby preventing failure of the improved container due to the fatigue stresses.

It is another objective of the present invention to provide an improved bayonet-type twist lock mechanism for use on freight-container lift mechanisms, the bayonet-type twist lock having a shorter tapered point, that extends into the lift casting a shorter distance than existing bayonet-type twist locks, thereby allowing the use of lift castings having shorter heights.

It is another objective of the present invention to provide an improved method of lifting and transporting freight containers.

It is another objective of the present invention to provide a method of substantially reducing bending stresses in freight containers.

It is another objective of the present invention to provide a method of preventing fatigue failure in freight containers.

DETAILED DESCRIPTION OF THE PREFERRED EMBODIMENT

Figure 1A:
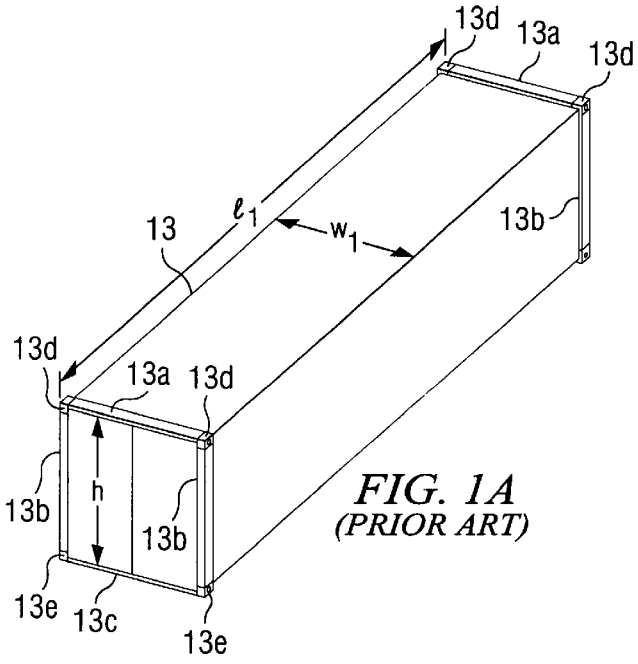
FIG. 1A (PRIOR ART)
FIGS. 1A–1E are perspective views of intermodal containers that illustrate an evolution of intermodal freight containers from a conventional International Standard Organization ("ISO") container through a container according to the present invention.
Figure 1B:
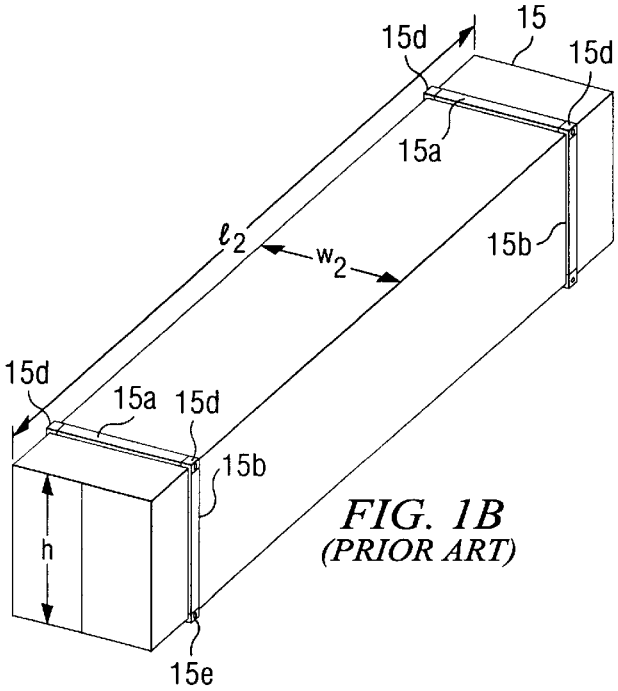
FIG. 1B (PRIOR ART)
Figures 1C, 1D, 1E:
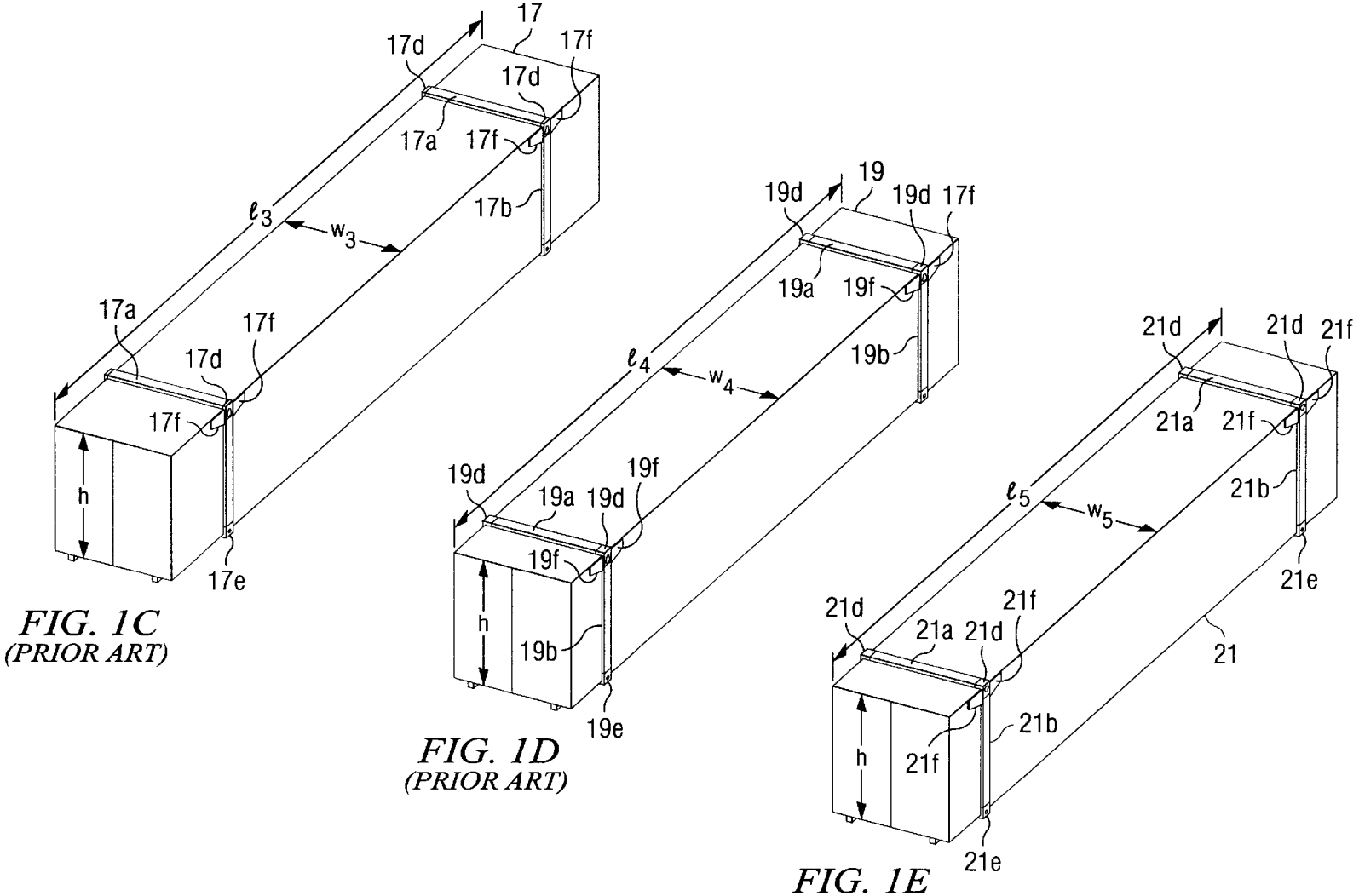
FIG. 1C (PRIOR ART)
FIG. 1D (PRIOR ART)

Referring to FIGS. 1A–1E in the drawings, a plurality of prior-art intermodal freight containers 11, 13, 15, 17, and 19 are illustrated. Intermodal freight container 21 is illustrative of the preferred embodiment of the present invention. Containers 13, 15, 17, 19, and 21 represent an evolution in intermodal freight container technology. Although containers 13, 15, 17, 19, and 21 are generally all of the same height h, containers 13, 15, 17, 19, and 21 may be classified by their differing lengths and widths. For example, container 13 represents a conventional ISO container having a length $\mathbf{1}_1$ of 40' and a width $w_1$ of 96"; container 15 represents a conventional "domestic" container having a length $\mathbf{1}_2$ of 48' and a width $w_2$ of 102"; container 17 represents a conventional container, typical of containers used by the J. B. Hunt Company, having a length $\mathbf{1}_3$ of 53' and a width $w_3$ of 102"; and container 19 represents another typical J.B. Hunt container having a length $\mathbf{1}_4$ of 48' and a width $w_4$ of 102". Container 21 represents a the preferred embodiment of the present invention, and has a length $\mathbf{1}_5$, preferably of about 48', and a width $w_5$, preferably of about 102". Hereinafter, containers having a width of 96" will be referred to as "standard" width containers; and containers having a width of 102" will be referred to as "wide" containers. Containers 13, 15, 17, 19, and 21 all include conventional locking doors for loading freight.

Containers 13, 15, 17, and 19 are typically constructed of steel support frames and aluminum skins. In container 13, a plurality of reinforcement beams, each consisting of a header 13*a*, two side posts 13*b*, and a footer 13*c*, were added around each end of container 13 to provide added strength for lifting and stacking container 13. A lift casting 13*d*, integrated into the reinforcement beam, was located at each joint of header 13*a* and side posts 13*b*. Likewise, a stack casting 13*e*, integrated into the reinforcement beam, was located at each joint of side posts 13*b* and footer 13*c*. Lift castings 13*d* and stack castings 13*e* will be discussed in more detail below. The remaining prior-art containers 15, 17, and 19 each contain similar reinforcement beams having headers 15*a*, 17*a*, and 19*a*; side posts 15*b*, 17*b* and 19*b*; footers 15*c*, 17*c*, and 19*c*; lift castings 15*d*, 17*d*, and 19*d*; and stack castings 15*e*, 17*e*, and 19*e*.

Figure 10A:
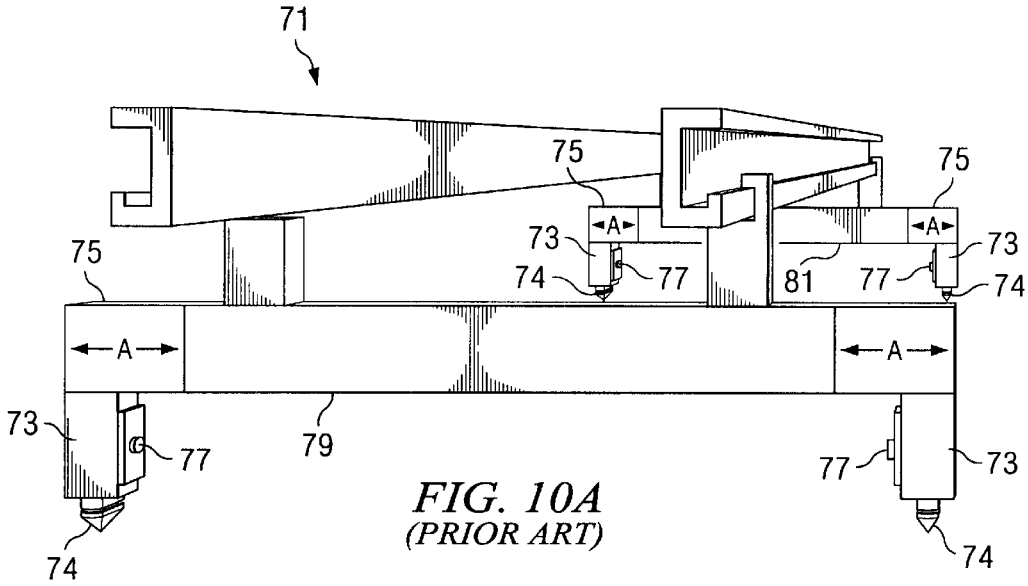
FIG. 10A (PRIOR ART)
FIGS. 10A and 10B are views of a prior-art lift mechanism having a bayonet-type twist lock member.
Figure 10B:
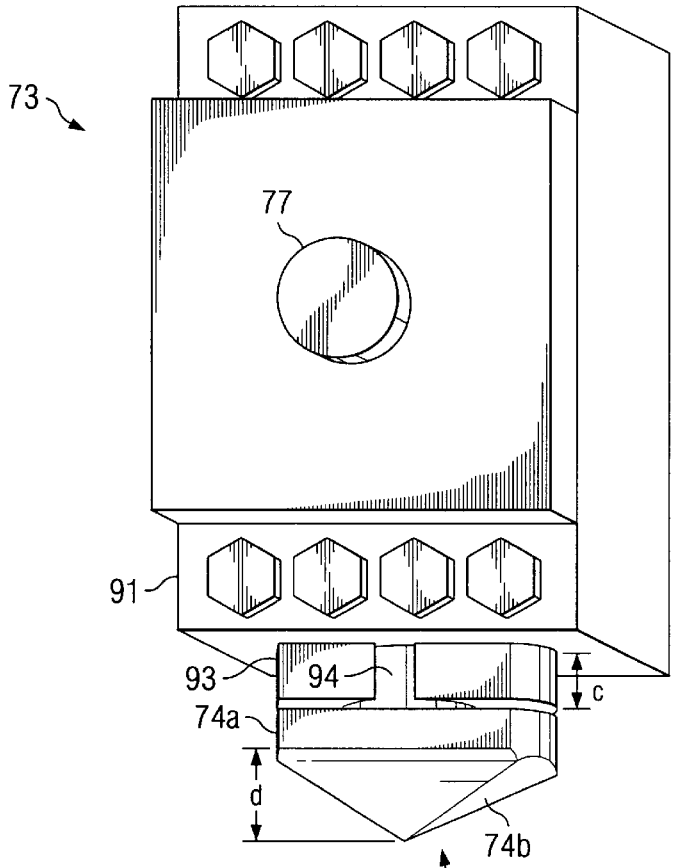
FIG. 10B (PRIOR ART)

All prior-art containers 13, 15, 17, and 19 are adapted in various ways to be lifted by conventional lift mechanisms (see FIGS. 10A and 10B). Lift castings 13*d*, 15*d*, and 19*d* include apertures (see FIG. 5) in their top surfaces that allow the respective containers to be grasped and lifted from the top by lift attachments, usually bayonet-type twist lock members, of the lift mechanisms. However, lift casting 17*d* only has an aperture (see FIG. 5) in its side surface; therefore container 17 must be lifted from the side by lift attachments that are adapted with inwardly protruding lift pins (see FIG. 10A). These lift mechanisms and lift attachments will be discussed in more detail below.

Continuing with reference to FIG. 1, container 21 is preferably constructed of a steel frame and a thin aluminum skin. Container 21 includes a plurality of reinforcement beams, each consisting of a header 21*a*, two side posts 21*b*, and a footer 21*c* (see FIG. 7). Headers 21*a*, side posts 21*b*, and the footers 21*c* surround container 21 to provide added strength for lifting and stacking container 21. A lift casting 21*d*, integrated into the reinforcement beam, is located at each joint of header 21*a* and side posts 21*b*. Likewise, a stack casting 21*e*, integrated into the reinforcement beam, is located at each joint of side posts 21*b* and footer 21*c*. Lift casting 21*d* and stack casting 21*e* will be explained in more detail below.

As is shown, the reinforcement beams of container 13 are located at the ends of container 13. Thus, the reinforcement beams are separated by a distance of about 40'. It should be noted, that although the overall length of freight containers has varied over the years, the distance between the reinforcement beams has remained constant at about 40'. Thus, the distance between the reinforcement beams on containers 15, 17, and 19 is about 40'. One reason for maintaining this spacing is so that the load-bearing reinforcement beams of newer containers align with the load-bearing reinforcement beams of older containers. Another reason for maintaining a common distance between reinforcement beams is that the lift castings 13*d*, 15*d*, 17*d*, 19*d*, and 21*d* remain equally spaced apart, and the lift mechanisms do not require modification or reprogramming. For these reasons, it is preferable that the distance between the reinforcement beams of container 21 is also about 40'.

As the length of freight containers grew beyond 40', it became necessary to add additional reinforcement adjacent to the lift castings to prevent container failure due to the longitudinal bending moment and bending stresses about the lift castings due to the added weight at the end of each container. For example, containers 17 and 19 include reinforcement plates 17*f* and 19*f*, respectively, to provide added strength against such failure. In a similar fashion, it is preferable that container 21 include reinforcement plates 21*f*.

Figure 2:
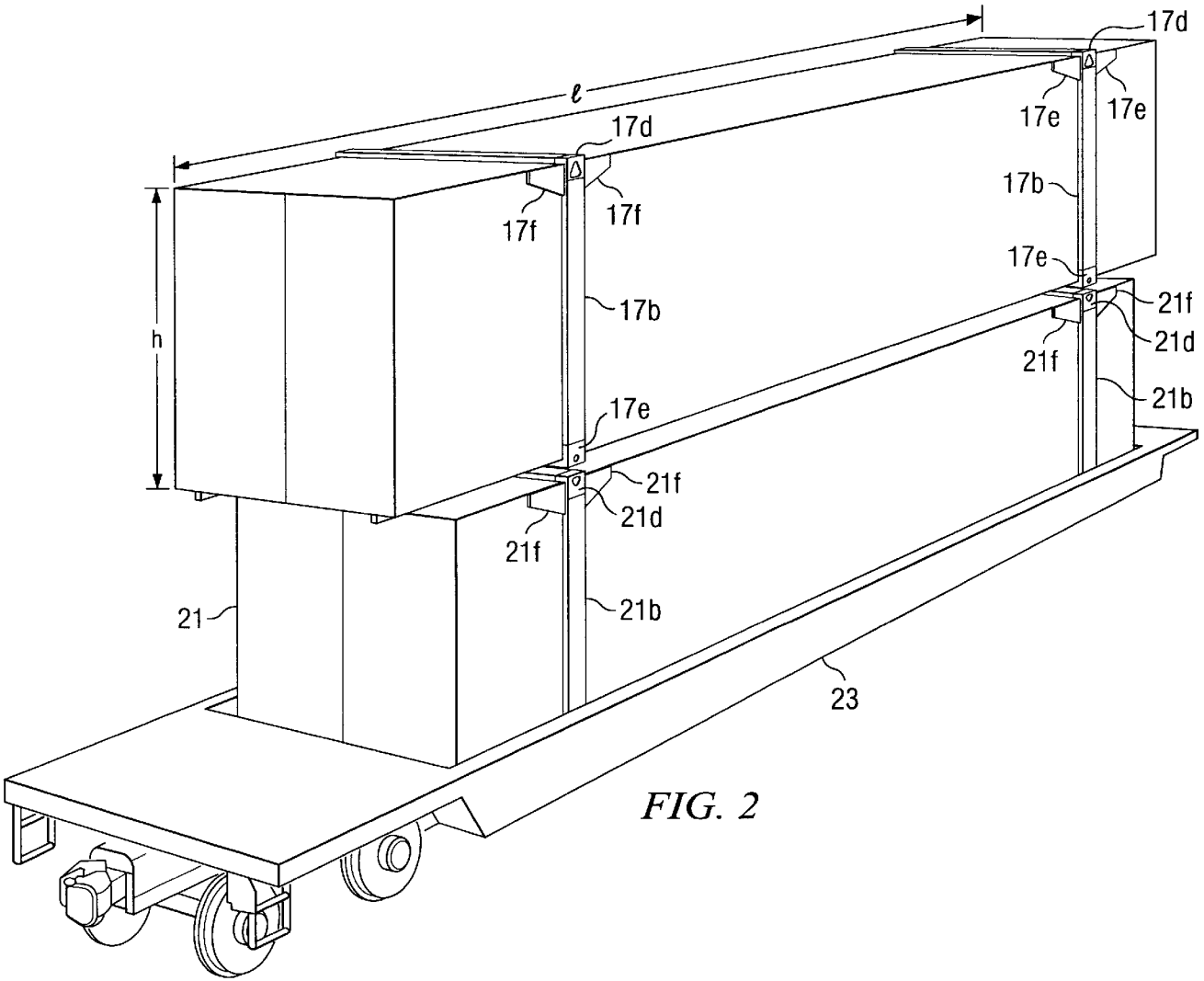
FIG. 2 is a perspective view of a conventional freight container stacked on top of a container according to the present invention, both containers being stacked on a railway flat car.

Referring now to FIG. 2 in the drawings, prior-art container 17 is shown stacked on top of container 21 of the present invention. Containers 17 and 21 are shown loaded on a conventional railroad flatcar 23 used in conventional intermodal transportation systems. Although container 17 has lift castings 17*d* that do not allow other containers to be stacked on top of container 17, container 21 is adapted to allow container 17 to be stacked on top of container 21. The desired alignment of the reinforcement beams of the two containers 17 and 21 is illustrated. As explained above, the reinforcement beams consist of headers 17*a* and 21*a*, side posts 17*b* and 21*b*, footers 17*c* and 21*c*, lift castings 17*d* and 21*d*, stack castings 17*e* and 21*e*, and reinforcement plates 17*f* and 21*f*. This alignment is desired so that the load of container 17 is properly carried by the reinforcement beams of container 21, not by the container skins of container 21.

When the load of container 17 is not properly distributed over the reinforcement beams of container 21, there is a possibility that container 21 will be damaged or will fail. As is shown, although the lengths of container 17 and container 21 are different, the widths are the same, about 102". In conventional intermodal transportation systems, it is desirable to stack containers of the same width on top of each other. If the upper container is not as wide as the lower container, undesirable bending moments are created about the lower lift castings, resulting in possible failures of the lower container, usually in the headers, the lift castings, or both. On the other hand, if the upper container is wider than the lower container, undesirable bending moments are created about the upper stack castings, resulting in possible failures of the upper container, usually in the footers, the stack castings, or both.

Figure 3A:
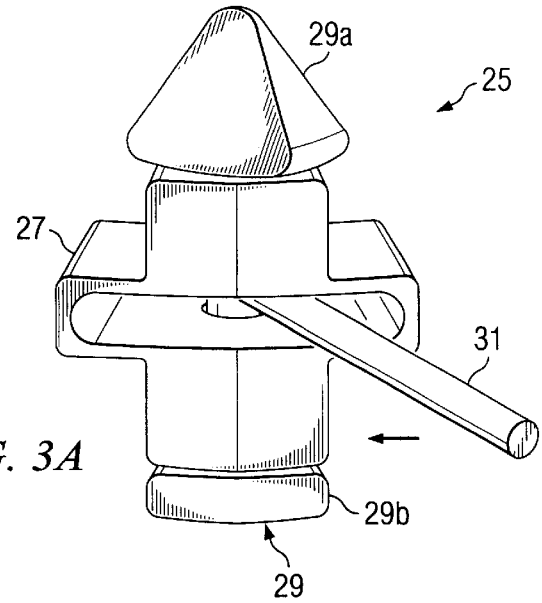
FIGS. 3A–3C are perspective views of a conventional IBC.
Figure 3B:
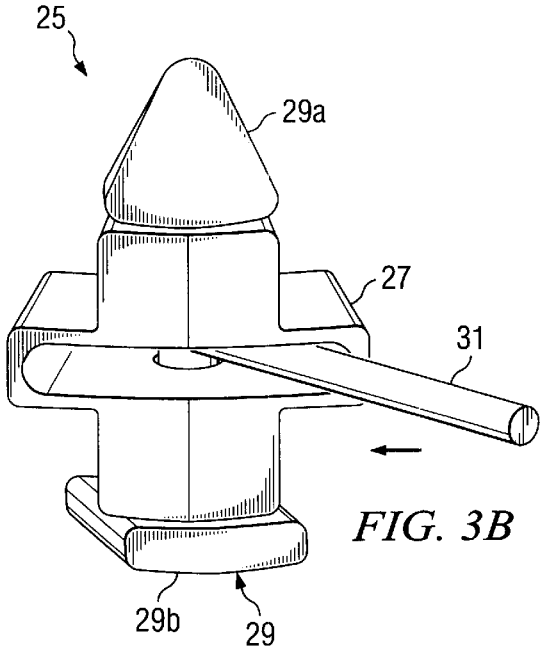
Figure 3C:
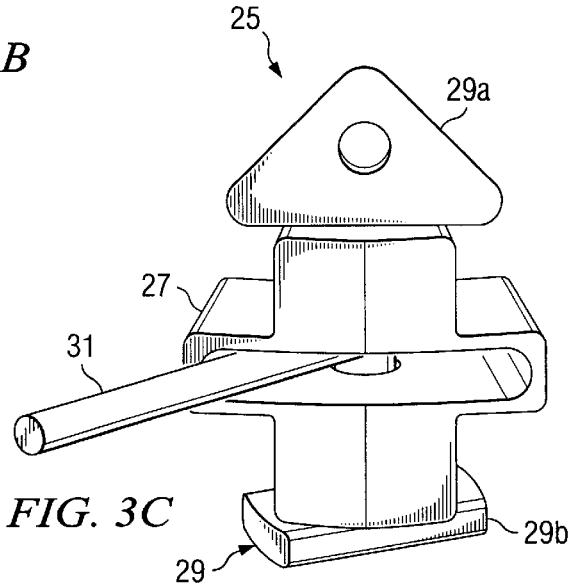
Figure 4:
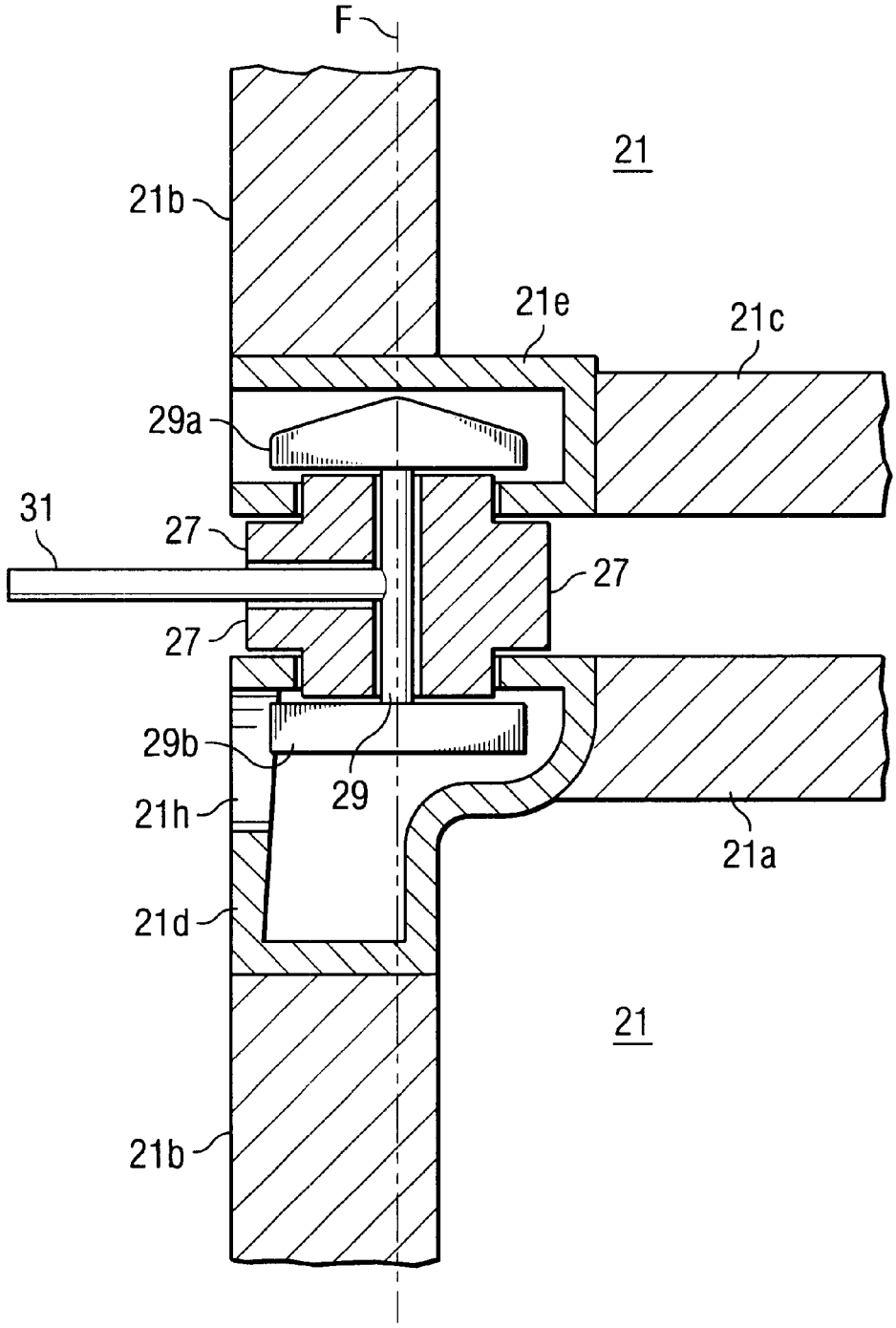
FIG. 4 is a cross-sectional view of the IBC of FIGS. 3A–3C connecting two containers wherein the two containers have lift castings and stack castings in accordance with the invention.
Figure 5C:
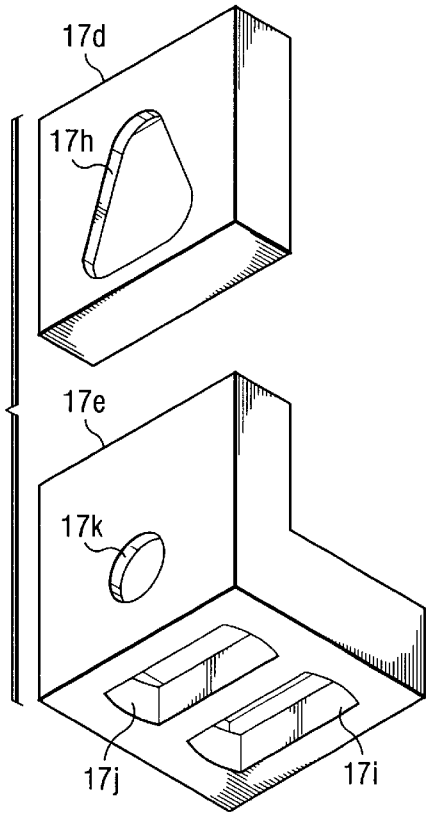
FIG. 5C (PRIOR ART)
FIGS. 5A–5E are perspective views of lift castings and corresponding stack castings that illustrate an evolution of lift castings and stack castings for containers from a conventional ISO container through a container according to the present invention.
Figure 5B:
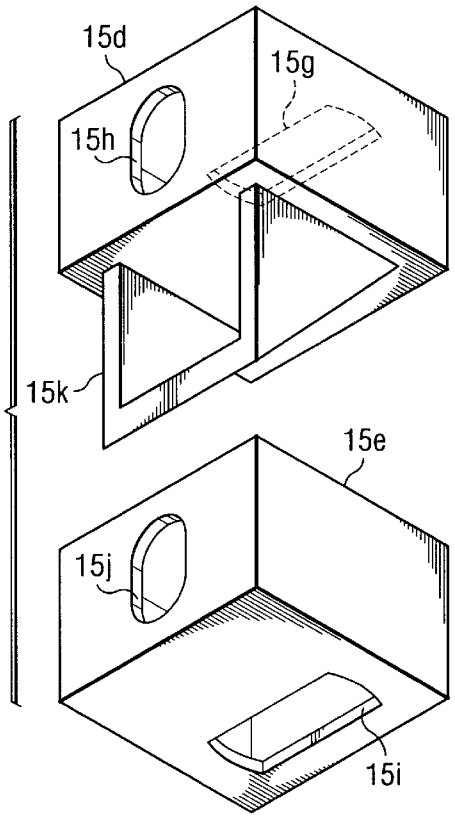
FIG. 5B (PRIOR ART)
Figure 5A:
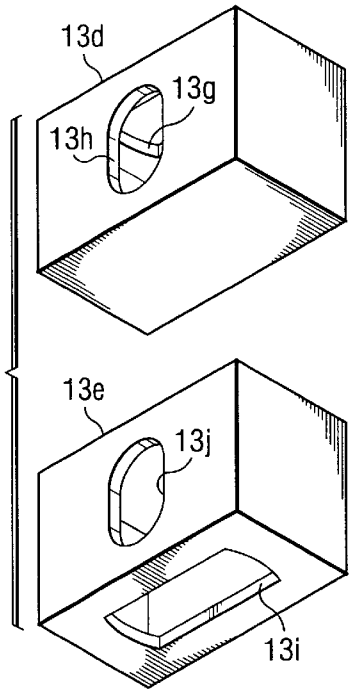
FIG. 5A (PRIOR ART)
Figure 5D:
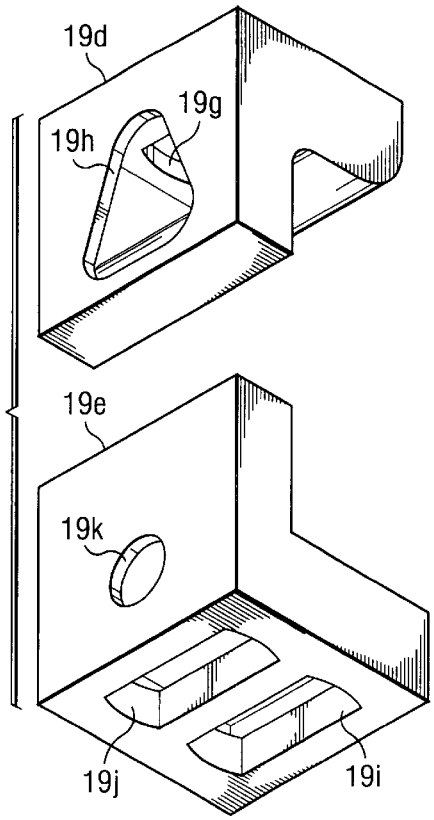
FIG. 5D (PRIOR ART)
Figure 5E:
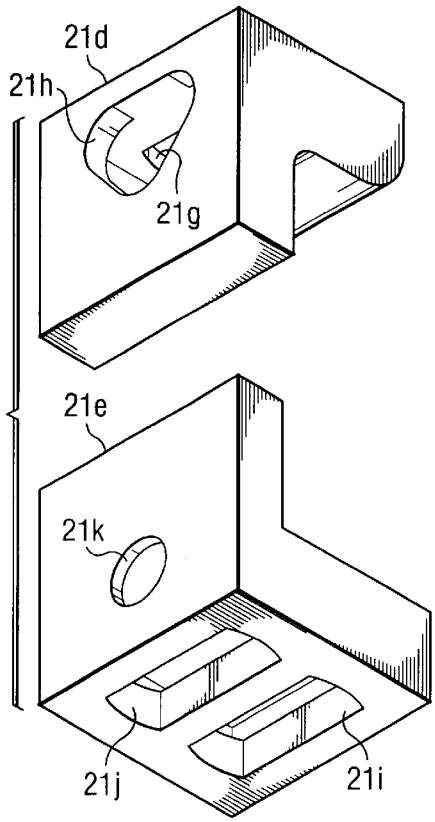
Figure 6A:
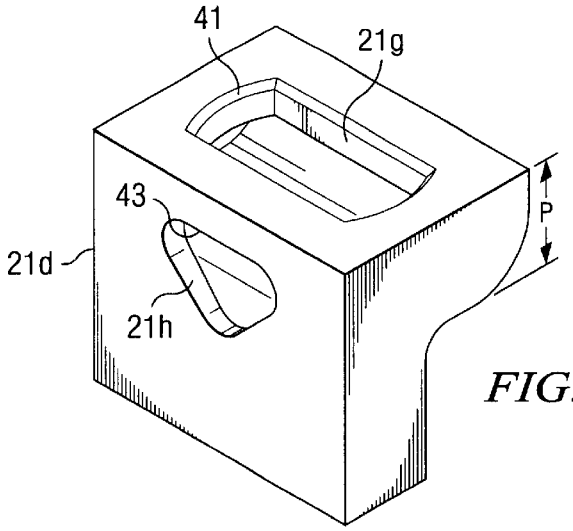
FIGS. 6A–6D are various views of the lift casting according to the present invention.
Figure 6B:
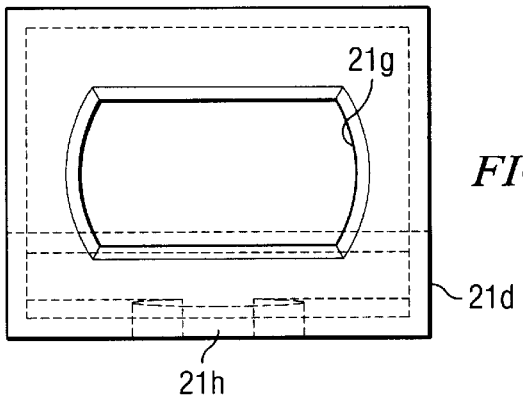
Figure 6C:
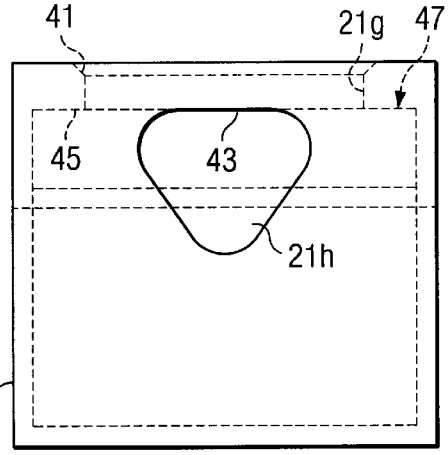
Figure 6D:
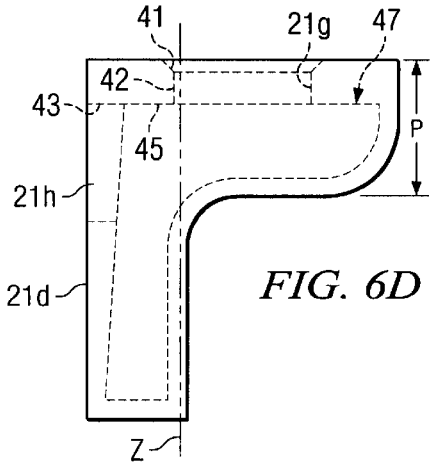

Referring now to FIGS. 3A–3C and 4 in the drawings, a conventional twist-lock IBC 25 is illustrated. FIGS. 3A–3C illustrate the twist-lock function of IBC 25, and FIG. 4 is a cross-sectional view of IBC 25 in a locked position interconnecting, for example, two containers 21, one on top of the other. Twist-lock IBC's 25, are necessary in conventional intermodal transportation systems to prevent shifting of the containers when the containers are stacked upon each other. IBC 25 includes a housing 27, a central shaft 29 having a top portion 29*a* and a bottom portion 29*b*, and a handle 31 connected to shaft 29 for pivoting top portion 29*a* and bottom portion 29*b* between a locked position and an unlocked position.

In operation, before an upper container is stacked on top of a lower container, an IBC 25 is placed in the top aperture of each lift casting of the lower container. The upper container is then lowered down on top of the IBC's 25. Often it is necessary for an operator to reach between the containers to align the IBC's 25, a potentially dangerous task. Thus, for safety reasons, it is desirable that IBC 25 be located as far outboard on containers 21 as possible to minimize the distance that an operator must reach between the containers. As will be explained below, this safety feature is provided by container 21. Once the upper container has been successfully lowered onto IBC's 25, the operator manually twist-locks the IBC's 25 by rotating handle 29. It is preferable that IBC 25 be as close in line with side posts 21*b* as possible, as indicated by line of force F. This ensures that the load of upper container 21 is transferred through stack casting 21*e*, through IBC 25, through lift casting 21*d*, to lower container 21, thereby minimizing bending stresses in the reinforcement beams. In addition, the use of IBC's 25 in conjunction with containers 21 according to the present invention reduces the chance of introducing undesirable bending moments and bending stresses in the reinforcement beams of containers 21. Although the operation of IBC 25 is entirely conventional, it is mentioned here because its operation is made more effective and safer by use of container 21 and the stacking methods according to the present invention.

Referring now to FIGS. 5A–5E in the drawings, lift castings 13*d*, 15*d*, 17*d*, 19*d*, and 21*d* of FIG. 1A–1E are illustrated in enlarged fashion with their corresponding stack castings 13*e*, 15*e*, 17*e*, 19*e*, and 21*e*. Lift casting 13*d* has an elongated top aperture 13*g* and an elongated side aperture 13*h*. Stack casting 13*e* has an elongated bottom aperture 13*i* and an elongated side aperture 13*j*. Lift casting 15*d* has an elongated top aperture 15*g* and an elongated side aperture 15*h*. Stack casting 15*e* has an elongated bottom aperture 15*i* and an elongated side aperture 15*j*. Lift casting 17*d* has only an upwardly pointed triangular side aperture 17*h*, which necessitates lifting from the side, and prevents other containers from being stacked on top of container 17, because there would be no aperture in which to lock IBC 25. Stack casting 17*e* has an elongated inboard bottom aperture 17*i*, an elongated outboard bottom aperture 17*j*, and a circular side aperture 17*k*. This dual aperture arrangement on stack casting 17*e* allows container 17 to be stacked on both standard width and wide containers.

Lift casting 19*d* has an elongated top aperture 19*g* and an upwardly pointing triangular side aperture 19*h*, which allows lifting from either the top or the side, and allows standard width containers to be stacked on top of container 19. However, it is important to note that top aperture 19*g* is located inboard on lift casting 19*d* near the joint of lift casting 19*d* and header 19*a*, such that top aperture 19*g* aligns with the bottom apertures of standard width containers, such as container 13, not wide containers. As will be explained below, container 21 of the present invention addresses this shortcoming. Stack casting 19*e* has an elongated inboard bottom aperture 19*i*, an elongated outboard bottom aperture 19*j*, and a circular side aperture 19*k*. Lift casting 21*d* of the present invention has an elongated top aperture 21*g* and a downwardly pointing triangular side aperture 21*h*. Stack casting 21*e* of the present invention has an elongated inboard bottom aperture 21*i*, an elongated outboard bottom aperture 21*j*, and a circular side aperture 21*k*. The purpose of elongated top apertures 13*g*, 15*g*, 19*g*, and 21*g* is to allow a bayonet-type twist lock member of a lift attachment on a lift mechanism (see FIGS. 10A and 10B) to be inserted into the elongated apertures 13*g*, 15*g*, 19*g*, and 21*g* and rotated 90° into a locked position, thereby allowing the container to be lifted.

Each successive pair of castings includes improved features over its predecessor. Lift casting 13*d* and stack casting 13*e* provided a simple means of stacking standard width containers 13, as long as the containers were exactly the same. Lift casting 15*d* and stack casting 15*e* allowed wide containers 15 to be stacked with standard width containers 13. This is why top aperture 15*g* and bottom aperture 15*i* are moved closer to the inboard edges of lift casting 15*d* and stack casting 15*e*. Due to the extra width of container 15, lift castings 15*d* and stack castings 15*e* had to be larger so as to extent farther inboard to align with the standard width container 13. In addition, it was necessary to add additional support members 15*k*. Support members 15*k* were bulkier and added an undesirable additional intrusion into the interior of container 15. When stacking containers 15 upon each other, the inboard location of top apertures 15*g* and bottom apertures 15*i* created undesirable bending stresses in the reinforcement beams of containers 15.

Lift castings 17*d* have no top aperture; therefore containers 17 must be lifted at side apertures 17*h* by lift mechanisms that have inwardly protruding lift pins 77 (see FIGS. 10A and 10B). In addition, lift castings 17*d* do not provide the necessary top apertures to receive IBC 25. Thus, no containers can be stacked on top of container 17. However, inboard bottom aperture 17*i* and outboard bottom aperture 17*j* allow container 17 to be stacked on top of either a wide container with an inboard top aperture, such as container 15, or a standard width container, such as container 13. With respect to lift casting 19*d*, upwardly pointing triangular side aperture 19*h*is identical in form and function as side aperture 17*h*. However, lift casting 19*d* includes a top aperture 19*g* that allows container 19 to be lifted from the top by a bayonet-type twist lock member of a lift mechanism (see FIGS. 10A and 10B). Stack castings 19*e* are identical in form and function as stack castings 17*e*.

It should be noted that top aperture 19*g* is located near the inboard edge of lift casting 19*d*. Although this allows standard width containers, such as container 13, to be stacked on top of container 19, the inboard location of top aperture 19*g* means that the load of the upper container transferred through IBC 25 is not properly aligned with the load bearing side posts 19*b* of container 19. Thus, undesirable bending stresses are created. In addition, even when stacking containers 19 upon each other, the inboard location of top apertures 19*g* and inboard bottom apertures 19*i* create the same bending stress problems in the reinforcement beams of containers 19.

On the other hand, these problems are solved by improved container 21, lift casting 21*d*, and stack casting 21*e*. Although stack casting 21*e* is very similar in form and function to stack castings 17*e* and 19*e*, top aperture 21*g* of lift casting 21*e* is located on lift casting 21*d* such that top aperture 21*g* is in an outboard position on container 21. This relocation of top aperture 21*g* to an outboard position aligns the load from wide containers stacked on top of container 21 along line of force F (see FIG. 4), thereby substantially reducing bending moments and bending stresses in container 21. For the same reason, this relocation of top aperture 21*g* to an outboard position substantially reduces fatigue stress, thereby preventing fatigue failure, extending the useful life, and reducing the cost of maintenance and inspection of container 21.

Referring now to FIGS. 6A–6D in the drawings, the preferred embodiment of lift casting 21*d* of the present invention is illustrated. It is important to note that elongated top aperture 21*g* is located at an outboard position, such that its vertical outboard surface 42 is substantially coplanar, i.e., very close to being in the same plane with, the interior surface of the side post 21*b*, as is shown by reference line Z, not at an inboard position as are top apertures 13*g*, 15*g*, and 19*g* of the prior-art lift castings 13*d*, 15*d*, and 19*d*, respectively. For this reason, lift casting 21*d* substantially reduces the undesirable bending stresses created when stacking prior-art containers. Lift casting 21*d* includes a bevel 41 that aids in the insertion of the bayonet-type twist lock member 74 of lift mechanism 71 (see FIG. 10B) into lift casting 21*d*. As is best seen in FIG. 60, downwardly pointing triangular side aperture 21*h* is located such that a top edge 43 is flush with an inside surface 45 of a top plate 47. This arrangement ensures clearance of a tab portion 74*a* (see FIG. 10B) of bayonet-type twist lock member 74 as it rotates 90° into its locked position. It should be understood that side aperture 21*h* may be of other geometrical shapes, including an upwardly pointing triangle. Top aperture 21*g* and side aperture 21*h* allow lift casting 21*d* to have a shorter height, or profile P, than prior-art lift castings. Therefore, lift casting 21*d* makes less of an intrusion into the interior of container 21, thereby providing more storage volume and reducing the time and maneuvering required to load container 21.

Figure 7:
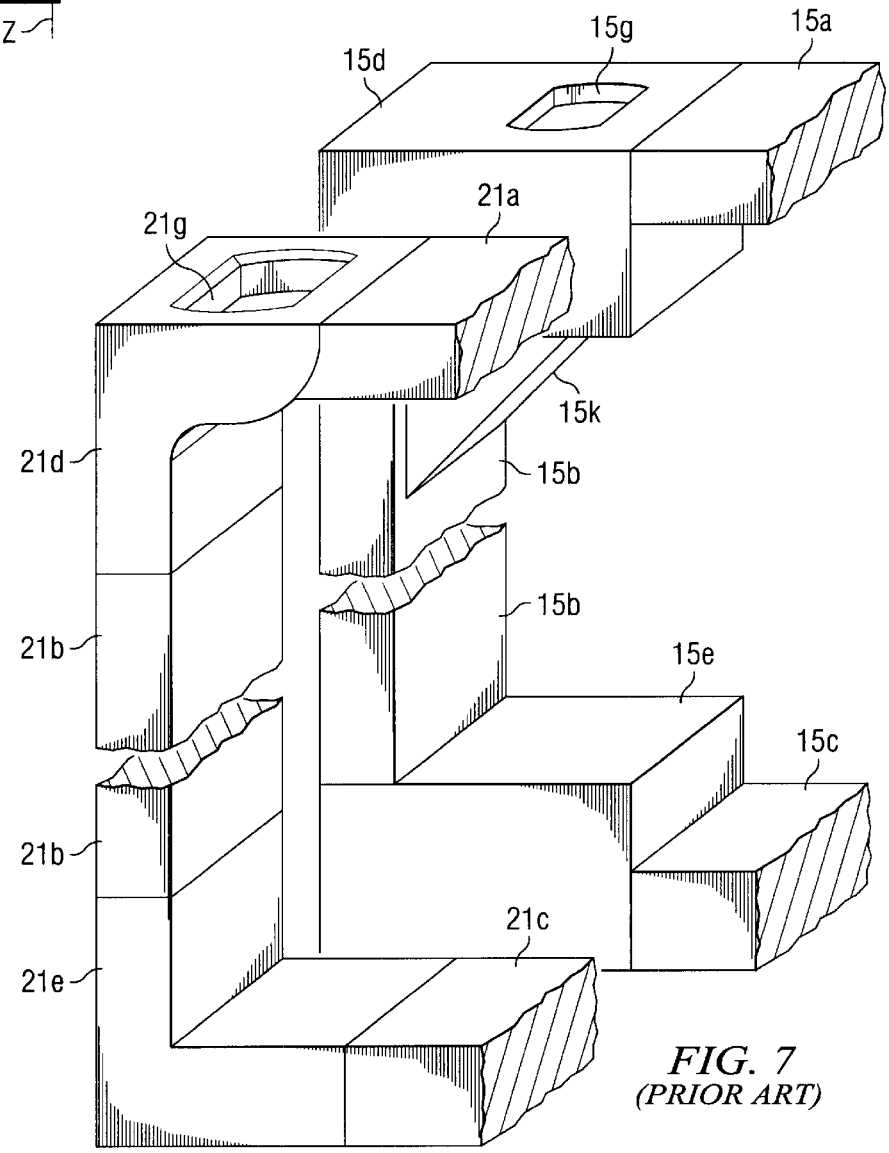
FIG. 7 (PRIOR ART)
FIG. 7 is a perspective view illustrating the relative differences in size between a conventional lift casting and stack castings, and the lift casting and stack casting according to the present invention.
Figure 8A:
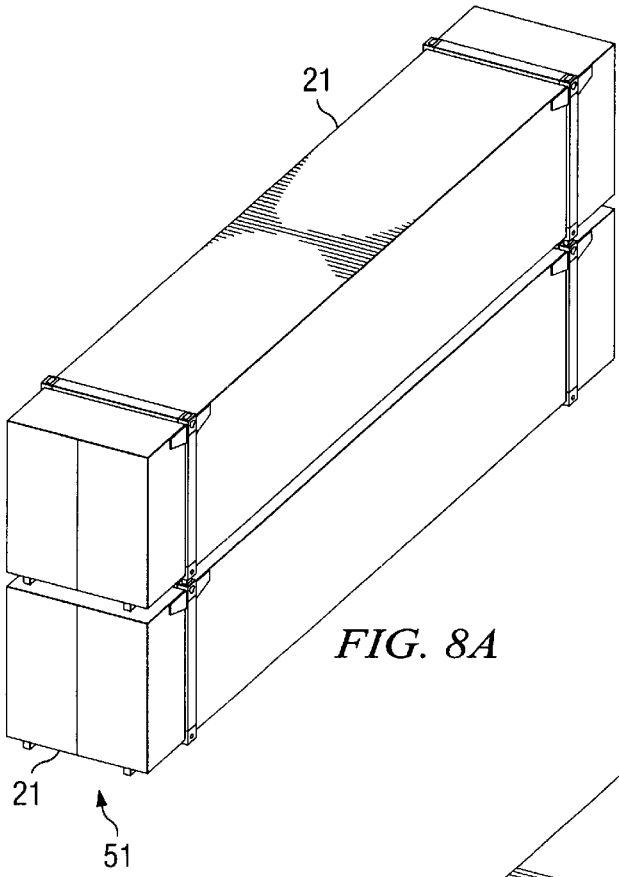
FIGS. 8A–8E are perspective views illustrating various stacking combinations in which the container according to the present invention is stacked with both similar containers and conventional containers.
Figure 8B:
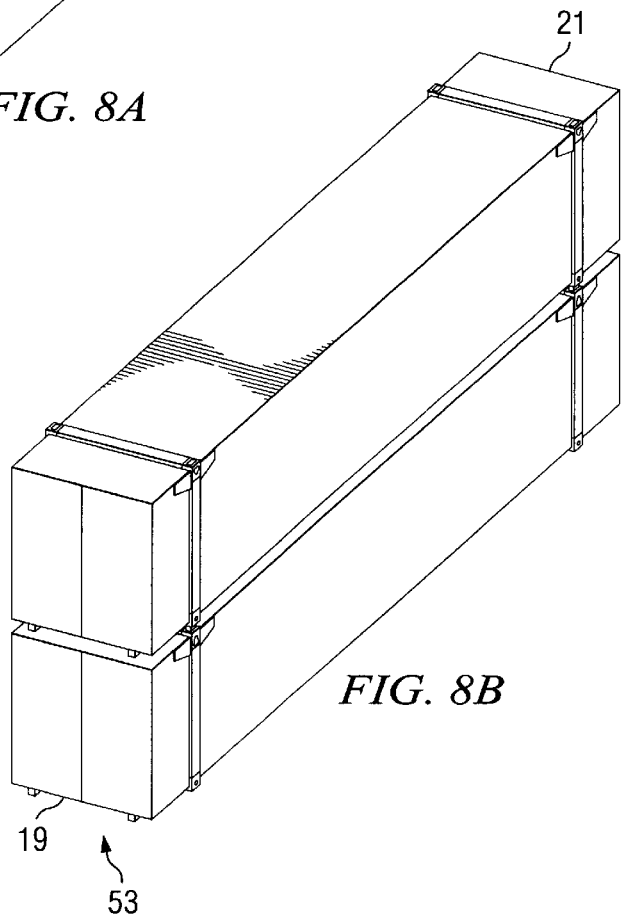
Figures 8C, 8D, 8E:
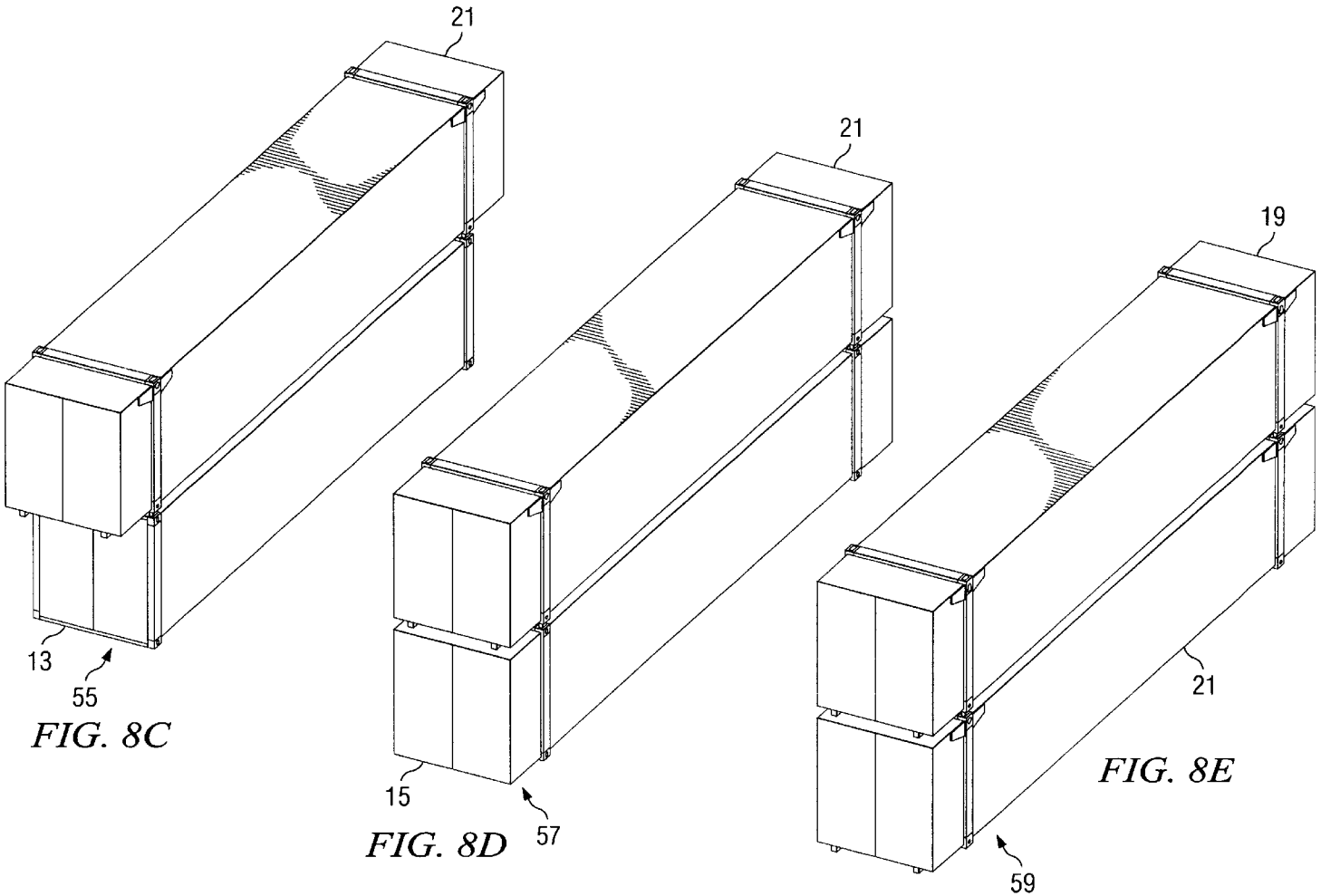

Referring now to FIG. 7 in the drawings, lift casting 21*d* and stack casting 21*e* of the present invention are illustrated in a side-by-side comparison with prior-art lift casting 15*d* and stack casting 15*e*. The lower edge of header 15*a* is generally flush with the interior of container 15, and the upper edge of footer 15*c* is generally flush with the interior of container 15. Likewise, the lower edge of header 21*a* is generally flush with the interior of container 21, and the upper edge of footer 21*c* is generally flush with the interior of container 21. As is shown, lift casting 21*d* and stack casting 21*e* require a much smaller intrusion into the interior of container 21 than lift casting 15*d*, with its necessary support member 15*k*, and stack casting 15*e* into the interior of container 15. As is shown, top aperture 15*g* is located in an inboard position close to the intersection of lift casting 15*d* and header 15*a*. Because top aperture 21*g* of lift casting 21*d* is located at an outboard position, container 21 may be stacked in a larger number of container combinations, without creating undesirable bending stresses.

Referring now to FIGS. 8A–8E in the drawings, a variety of container stacking combinations is illustrated. Lift casting 21*d* and stack casting 21*e* allow container 21 to be stacked in a large number of stacking combinations involving a variety of prior-art containers. For example, a first combination 51 includes container 21 stacked on top of an identical container 21. A second combination 53 includes container 21 stacked on top of equal length, wide container 19. A third combination 55 includes container 21 stacked on top of a shorter, standard-width container 13. A fourth combination 57 includes container 21 stacked on top of equal length, wide container 15. A fifth combination 59 includes wide container 19 stacked on top of equal length container 21. In combination 59, container 19 may be replaced by container 17 that is the same width as container 21, but that is longer than container 21. It should be understood that these examples are to illustrate the wide variety of stacking combinations that are permitted by the present invention. These examples are not intended to limit the number of stacking combinations in which container 21 may be utilized.

Figure 9A:
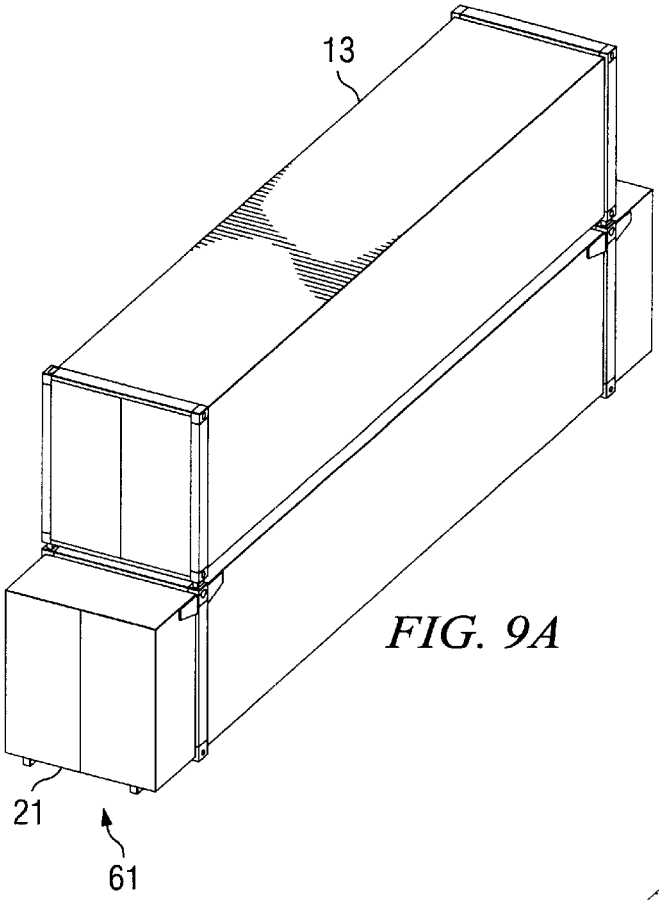
FIGS. 9A and 9B are perspective views illustrating a limited number of stacking combinations in which the container according to the present invention cannot be stacked with conventional containers.
Figure 9B:
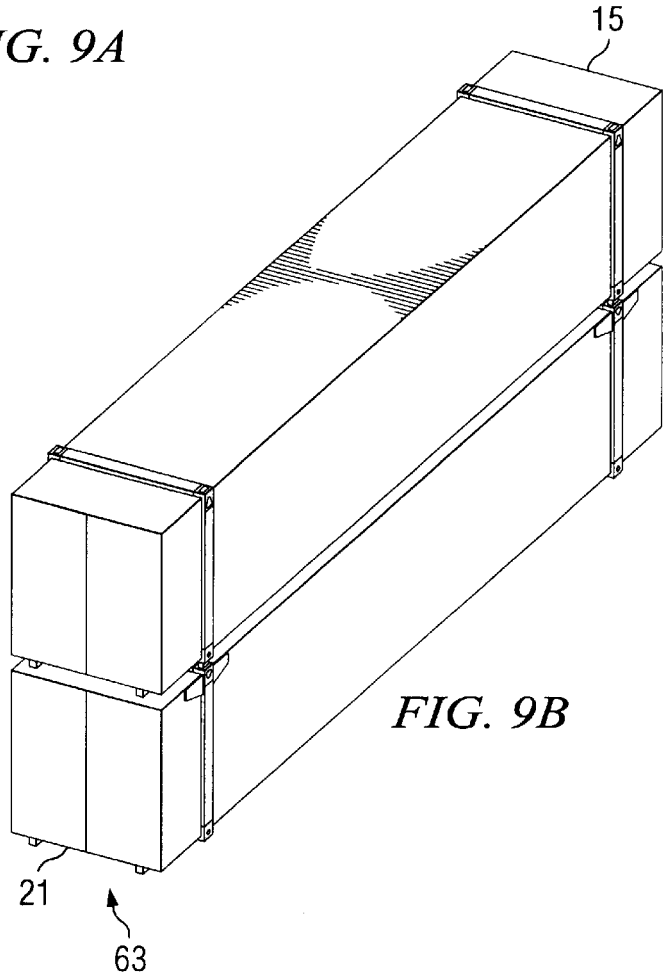

Referring now to FIGS. 9A and 9B in the drawings, a variety of container stacking combinations that are not available when using container 21 are illustrated. Although lift casting 21*d* and stack casting 21*e* allow container 21 to be stacked in a large number of stacking combinations involving a variety of prior-art containers, a small number of combinations are not available due to container interconnection incompatibilities. For example, in a first excluded combination 61, a standard width container 13 cannot be stacked on top of container 21. In a second excluded combination 63, container 15 cannot be stacked on top of container 21. It should be understood that there may be other stacking combinations that are not possible due to container interconnection incompatibilities. The stacking combinations illustrated in FIGS. 9A and 9B are not possible.

Referring now to FIGS. 10A and 10B in the drawings, a conventional hydraulic twist-lock lift mechanism 71 for lifting and moving freight containers is illustrated. Lift mechanism 71 has four lifting attachments 73, each having a bayonet-type twist lock member 74. Lifting attachments 73 are located at the end of extensible arms 75, that are adjustable in the direction of arrows A to accommodate containers of varying widths, or containers that must be lifted from side apertures, such as container 17 described above. In order to lift containers from the side, each lift attachment 73 is equipped with an inwardly extending lift pin 77. Lift pins 77 may be retractable to allow for additional clearance between the container and lift attachment 73. Lift mechanism 71 generally has transverse booms 79 and 81 to carry extensible arms 75. The distance between booms 79 and 81 is generally adjustable, although the length between lift castings on containers has been standardized at about 40'.

Bayonet-type twist lock member 74 of lift attachment 73 is best seen in FIG. 10B. As is shown, lift attachment 73 includes a housing 91 having a lower collar 93. Collar 93 has an elongated shape that corresponds with elongated top apertures 13*g*, 15*g*, 19*g*, and 21*g*. In addition, collar 93 has a height c that generally corresponds with the thickness of top apertures 13*g*, 15*g*, 19*g*, and 21*g*. Housing 91 houses a rotatable shaft 94 and means (not shown) for actuating rotatable shaft 94. Bayonet-type twist lock member 74 is coupled to rotatable shaft 94. Bayonet-type twist lock member 74 includes a tab portion 74*a* and a tapered portion 74*b* that tapers to a point over a vertical distance d.

In operation, to lift container 19, lift attachments 73 are aligned by an operator with top apertures 19*g*. Lift attachments 73 are then lowered such that bayonet-type twist lock members 74 are inserted through top apertures 19*g* in lift castings 19*d*. Once inserted, bayonet-type twist lock members 74 are rotated 90° by shaft 94 into a locked position, such that tab portions 74*a* are no longer aligned with elongated top apertures 19*g*. Once lift attachment is in the locked position, lift mechanism 71 can safely lift and transport container 19. The vertical clearance inside the interior of lift casting 19*d* must be large enough to allow full insertion of tab portion 74*a* and tapered portion 74*b*.

Figure 11:
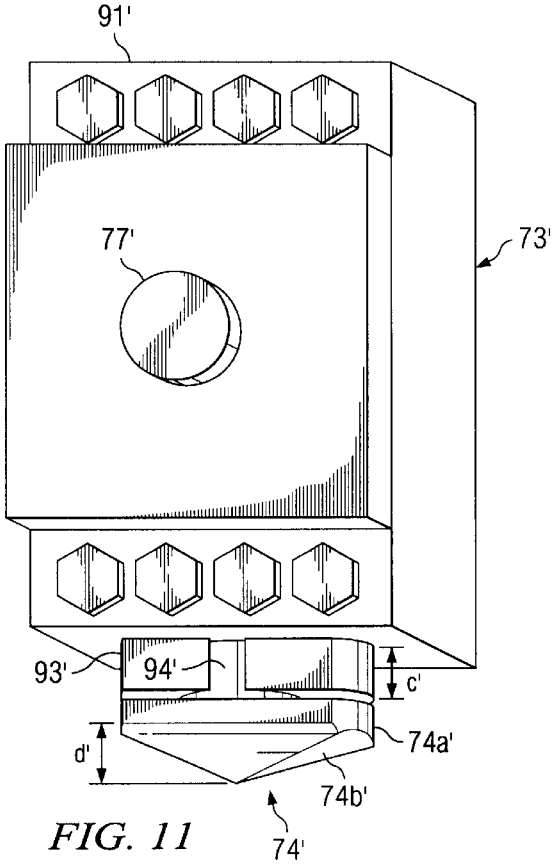
FIG. 11 is a perspective view of a bayonet-type lift mechanism according to an alternate embodiment of the present invention.

Referring now to FIG. 11 in the drawings, an alternate embodiment of the present invention is illustrated. In this alternate embodiment, improved lifting attachments 73' replace lifting attachments 73 in lift mechanism 71 for lifting container 21, or any other container with a short profile P (see FIGS. 6A and 6D). Each lift attachment 73' is equipped with an inwardly extending lift pin 77'. Lift pins 77' may be retractable to allow for additional clearance between the container and lift attachment 73'. Lift attachment 73' includes a bayonet-type twist lock member 74'. As is shown, lift attachment 73' includes a housing 91' having a lower collar 93'. Collar 93' has an elongated shape that corresponds with elongated top apertures 13*g*, 15*g*, 19*g*, and 21*g*. In addition, collar 93' has a height c' that generally corresponds with the thickness of top apertures 13*g*, 15*g*, 19*g*, and 21*g*. Housing 91' houses a rotatable shaft 94' and means (not shown) for actuating rotatable shaft 94'.

Bayonet-type twist lock member 74' is coupled to rotatable shaft 94'. Bayonet-type twist lock member 74' includes a tab portion 74*a*' and a tapered portion 74*b*' that tapers to a point over a vertical distance d'. Lift attachment 73' is very similar in form and function to lift attachment 73, with the exception that vertical distance d' is slightly shorter than vertical distance d. This shorter distance d' allows lift mechanism 73' to be used to lift containers having short profiles, such as profile P of container 21. This, in turn, means that the lift castings intrude less into the interior of the containers, thereby providing more usable volume within the containers, and reducing the amount of maneuvering that an operator must perform while loading the containers. Although tab portion 74*a*' is reduced in thickness, and tapered portion is reduced in height, bayonet-type twist lock member 74' retains sufficient strength to twist lock and lift containers at full capacity.

Figure 12A:
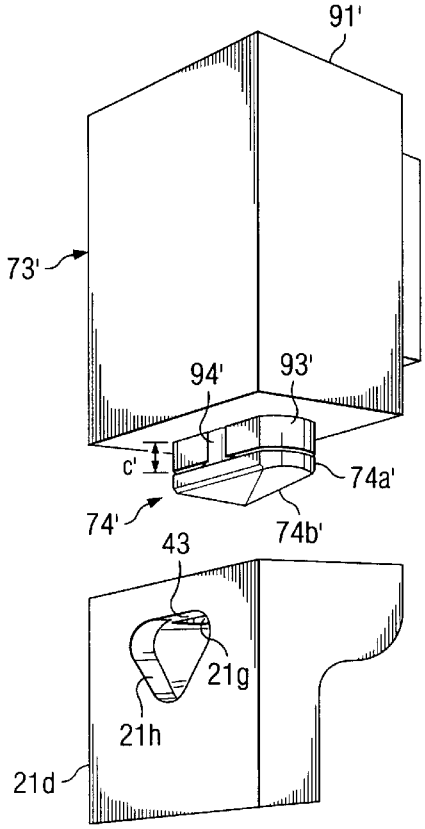
FIGS. 12A–12C are progressive perspective views of the lift mechanism of FIG. 11 engaging the lift casting according to the present invention.
Figure 12B:
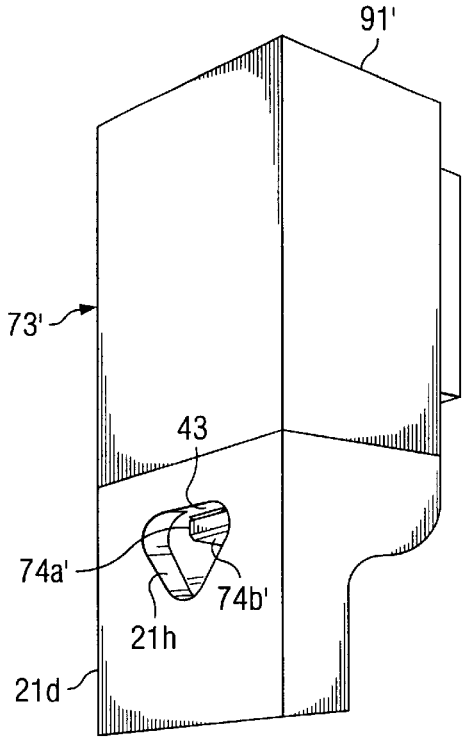
Figure 12C:
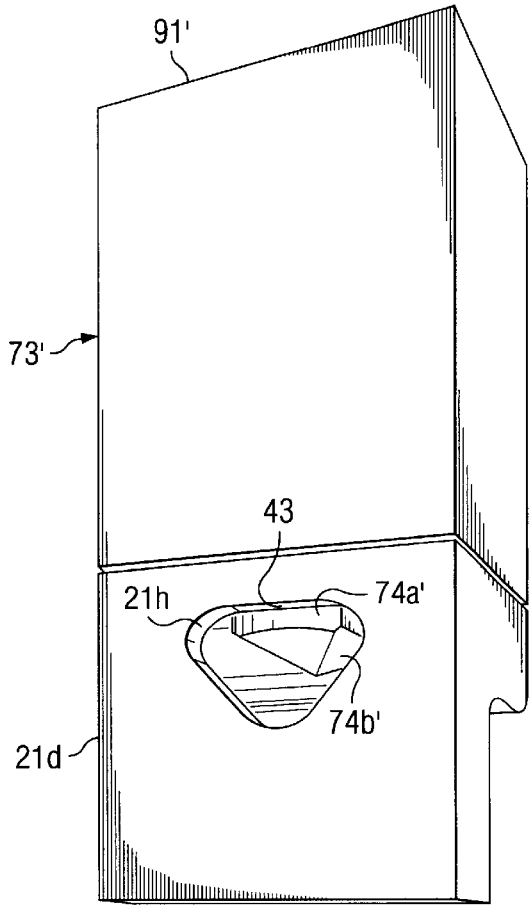

Referring now to FIGS. 12A–12C in the drawings, lift attachment 73' of the present invention is shown in progressive perspective views twist-locking onto lift casting 21*d* of the present invention. As is shown, after bayonet twist lock member 74' has been inserted through top aperture 21*g*, tab portion 74*a*' and tapered portion 74*b*' are rotated 90° by shaft 94'. Once lift attachment 73' has twist-locked onto lift casting 21*d*, container 21 may be lifted and transported by a lift mechanisms, such as lift mechanism 71. It is important to note that lift casting 21*d* may be used with existing conventional lift mechanisms and lift attachments, such as conventional lift attachment 73 in FIG. 10B. In other words, lift casting 21*d* is dimensionally adapted for use with existing lift attachments 73, and it is not necessary that distance d be shortened to accommodate lift casting 21*d*. The embodiment of the present invention shown in FIG. 11 and described above, allows lift casting 21*d* to have an even shorter profile P, thereby intruding less into the interior of container 21.

Figure 13:
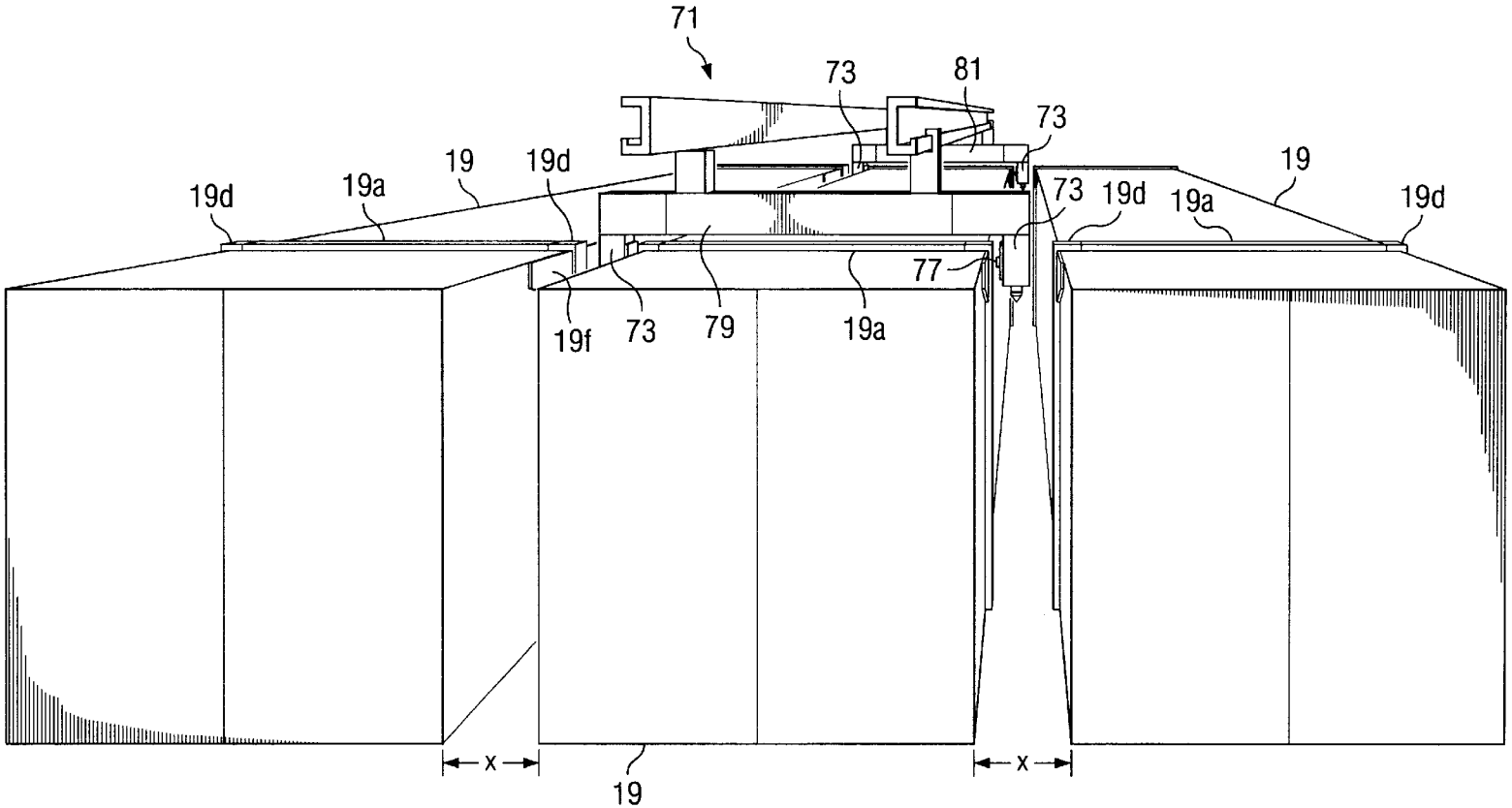
FIG. 13 (PRIOR ART)
FIG. 13 is a perspective view illustrating ground stacking of prior-art containers.

Referring now to FIG. 13 in the drawings, a plurality of containers 19 are shown stacked side-by-side. As explained above, containers 19 may be lifted from either top apertures 19*g* or side apertures 19*h* in lift castings 19*d*. As is shown, lift mechanism 71 is utilizing lift pins 77 to lift containers 19 from side apertures 19*h*. In order to place containers 19 side-by-side, it is necessary to leave a clearance x between each container 19, clearance x being large enough for lift attachment 73 to pass therethrough as side pin 77 is being aligned with side aperture 19*h*. The disadvantages associated with such side-lifting and storing methods should be apparent, including: side lifting requires additional space x between containers 19; clearance x provides little space for lift attachment 73 to pass through; and the operator's visibility, necessary to align side pin 77 with side apertures 19*h*, is greatly reduced, thereby increasing the possibility that container 19 will be damaged by lift mechanism 71. It should be understood that containers 17, which can only be lifted from side apertures 17*h*, present the same problems and disadvantages as containers 19, when containers 19 are lifted from side apertures 19*h*.

Figure 14:
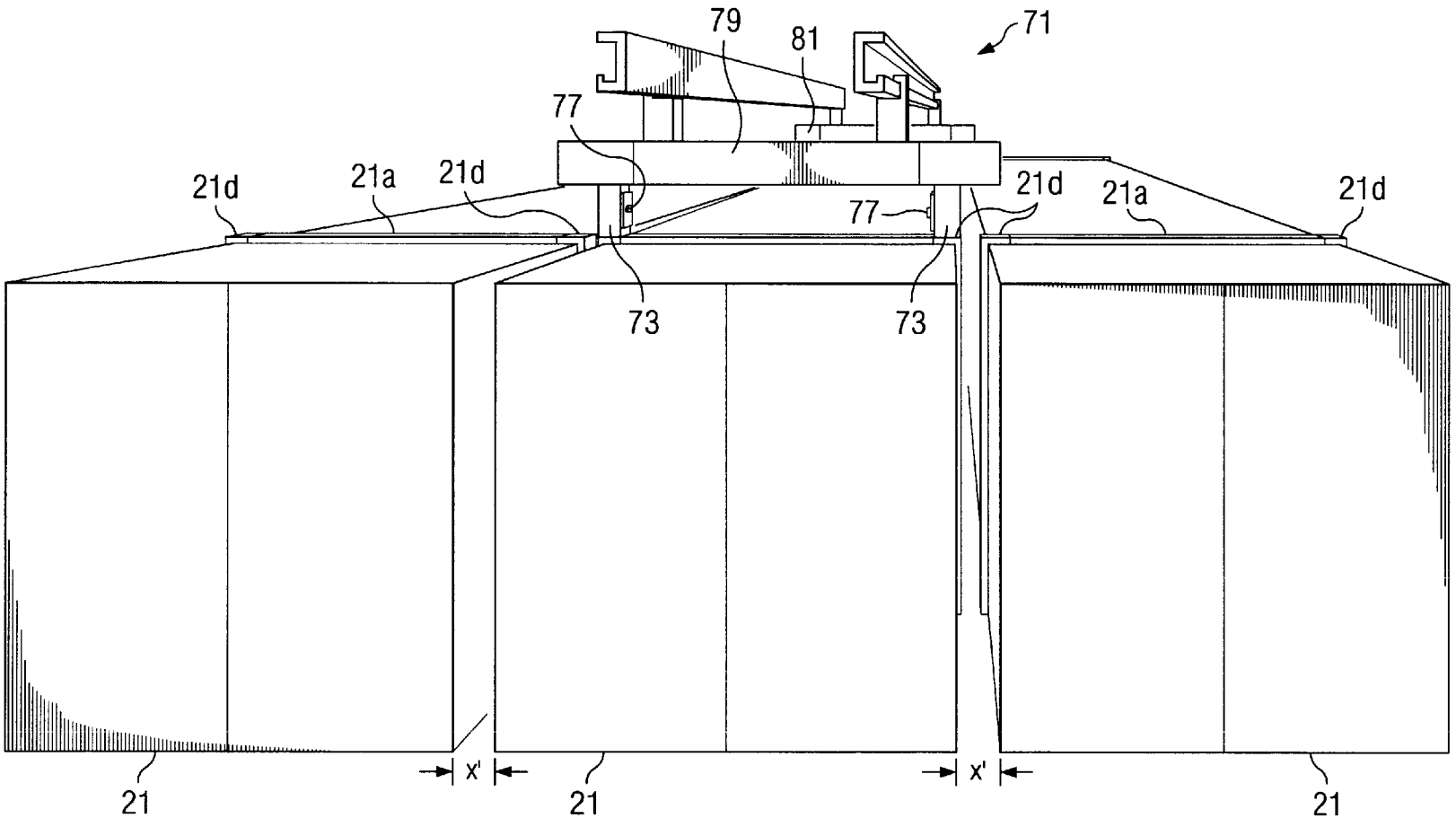
FIG. 14 is a perspective view illustrating ground stacking of containers according to the present invention.

Referring now to FIG. 14 in the drawings, a plurality of containers 21 according to the present invention are shown stacked side-by-side. Although containers 21 may be lifted from either top apertures 21*g* or side apertures 21*h* in lift castings 21*d*, it is preferred that containers 21 be lifted by top apertures 21*g*. As is shown, lift mechanism 71 is utilizing bayonet-type twist lock members 74 to lift containers 21 from top apertures 21*g*. Containers 21 may be placed side-by-side leaving only a minimal clearance x' between each container 21. Lift attachment 73 does not have to pass through clearance x' to stack containers 21 side-by-side. Thus, the advantages associated with top-lifting and storing methods should be apparent, including: top lifting does not require additional space x between containers 21; more containers 21 can be stored side-by-side than when using side-lifting methods; lift attachment 73 does not have to pass through clearance x'; and the operator's visibility is maximized, thereby reducing the possibility of damage to container 21 by lift mechanism 71. It should be understood that the foregoing applies to all top-lift containers, such as containers 13, 15, 19 (when lifted from the top), and 21.

It should be apparent from the foregoing that an invention having significant advantages has been provided. While the invention is shown in only one of its forms, it is not just limited but is susceptible to various changes and modifications without departing from the spirit thereof.

I claim:

1. A freight container for use with an existing lift mechanism, the freight container comprising:

a rigid support structure having a horizontal roof, vertical side walls, a horizontal floor, and at least one door;

at least two reinforcement beams, each having a horizontal header coupled to the roof, a pair of vertical side posts coupled to the side walls, and a horizontal footer coupled to the floor, each side post having a transversely interior surface and an opposing transversely exterior surface;

a stack casting disposed between each footer and each side post, the stack casting having a horizontal bottom plate and at least one stack aperture passing through the bottom plate, the stack aperture being adapted to allow stacking of the freight container; and a lift casting disposed between each header and each pair of side posts, each lift casting comprising:

a horizontal upper plate; and at least one longitudinally elongated lift aperture through the upper plate, the elongated lift aperture being located in an outboard position on the upper plate that is a transverse distance from a center of the header such that an outboard elongated side wall of the elongated lift aperture formed in the upper plate is substantially vertically aligned with the transversely interior surface of each corresponding side post.

2. The freight container according to claim 1, wherein each lift casting further comprises:

a vertical transversely outboard side plate; and a side lift aperture passing through the transversely outboard side plate.

3. The freight container according to claim 2, wherein each side lift aperture is generally triangularly shaped.

4. The freight container according to claim 3, wherein each generally triangularly shaped side lift aperture points downward.

5. The freight container according to claim 3, wherein each generally triangularly shaped side lift aperture points upward.

6. The freight container according to claim 4, wherein:

each top plate of each lift casting has a selected thickness, thereby defining an upper surface and an interior surface; and wherein each generally triangularly shaped side lift aperture has a top edge that is flush with the interior surface to allow the lift mechanism to extend therethrough.

7. The freight container according to claim 5, wherein:

each top plate of each lift casting has a selected thickness, thereby defining an upper surface and an interior surface; and wherein each generally triangularly shaped side lift aperture has a point that is flush with the interior surface to allow the lift mechanism to extend therethrough.

8. The freight container according to claim 1, wherein the lift casting further comprises:

a bottom plate that is generally parallel to the upper plate, the bottom plate and the upper plate defining therebetween an internal clearance that is substantially the same as the height of a bayonet portion of the lift mechanism.

9. The freight container according to claim 8, wherein the lift casting is configured with a curved internal surface such that intrusion into the interior of the container is substantially eliminated.

10. The freight container according to claim 1, wherein the elongated lift apertures are substantially aligned with vertical lines of force acting through the side posts, such that bending stresses in the freight container are substantially reduced.

11. The freight container according to claim 1, wherein the elongated lift apertures are aligned with vertical lines of force acting through the side posts, such that fatigue stresses in the freight container are substantially reduced.

12. The freight container according to claim 10, wherein the lines of force are created by stacking a first freight container on top of a second freight container, such that the stack castings of the first container are coupled to the lift castings of the second container.

13. The freight container according to claim 11, wherein the lines of force are created by stacking a first freight container on top of a second freight container, such that the stack castings of the first container are coupled to the lift castings of the second container.

14. The freight container according to claim 11, wherein the freight container is at least 102 inches wide and the elongated lift apertures are at least 96 inches apart, such that the freight container may be interlockingly stacked in combination with any freight container having lift and stack apertures 96 inches apart.

15. The freight container according to claim 11, wherein the freight container is about 102 inches wide and the transversely outboard stack apertures are about 96 inches apart, such that the freight container may be interlockingly stacked in combination with any freight container having lift and stack apertures 96 inches apart.

16. Amended) The freight container according to claim 1, wherein the locations of the at least one stack aperture and the at least one elongated lift aperture allow the freight container to be stacked on top of containers having smaller widths.

17. A freight container comprising:

a rigid support structure having a horizontal roof, vertical side walls, a horizontal floor, and at least one door;

at least two reinforcement beams, each having a horizontal header coupled to the roof, a pair of vertical side posts coupled to the side walls, and a horizontal footer coupled to the floor, each side post having a transversely interior surface and an opposing transversely exterior surface;

a stack casting disposed between each footer and each side post, the stack casting having a horizontal bottom plate, a transversely inboard stack aperture passing through the bottom plate, and a transversely outboard stack aperture passing through the bottom plate: and a lift casting disposed between each header and each pair of side posts, each lift casting comprising:

a horizontal upper plate; and at least one longitudinally elongated lift aperture through the upper plate, the elongated lift aperture being located in an outboard position on the upper plate that is a transverse distance from a center of the header such that an outboard elongated side wall of the elongated lift aperture formed in the upper plate is substantially vertically aligned with the transversely interior surface of each corresponding side post.

18. The freight container according to claim 17, wherein the transversely outboard stack aperture is vertically aligned with the elongated lift aperture.

* * * * *